US009636834B2

(12) United States Patent
Mann et al.

(10) Patent No.: US 9,636,834 B2
(45) Date of Patent: May 2, 2017

(54) AUTOMATED MACHINE FOR SLITTING AND WEDGE CUTTING WHOLE FRUITS AND VEGETABLES

(71) Applicant: 101238845 Saskatchewan, Ltd., Saskatchewan (CA)

(72) Inventors: Barrie Alan Mann, Las Vgas, NV (US); Kevin Gerald Szakacs, Burlington (CA); Leonard Fraitag, San Diego, CA (US); Steven Ray Card, San Diego, CA (US)

(73) Assignee: Supracut System International, Inc., Saskatchewan (CA)

( * ) Notice: Subject to any disclaimer, the term of this patent is extended or adjusted under 35 U.S.C. 154(b) by 295 days.

(21) Appl. No.: 14/222,466

(22) Filed: Mar. 21, 2014

(65) Prior Publication Data

US 2015/0266196 A1 Sep. 24, 2015

(51) Int. Cl.

| | |
|---|---|
| ***B26D 3/26*** | (2006.01) |
| ***B26D 5/08*** | (2006.01) |
| ***B26D 7/01*** | (2006.01) |
| ***B26D 7/22*** | (2006.01) |

(52) U.S. Cl.

CPC ..... *B26D 5/08* (2013.01); *B26D 3/26* (2013.01); *B26D 7/01* (2013.01); *B26D 7/22* (2013.01); *B26D 2210/02* (2013.01); *Y10T 83/0524* (2015.04); *Y10T 83/162* (2015.04)

(58) Field of Classification Search

CPC ..... B26D 2210/02; B26D 3/26; B26D 5/08; B26D 7/01; B26D 7/22; B26D 3/245; B26D 3/24; B26D 3/18; B26D 3/185; B26D 3/20; Y10T 83/0524; Y10T 83/162

See application file for complete search history.

(56) References Cited

U.S. PATENT DOCUMENTS

| | | | | |
|---|---|---|---|---|
| 2,513,341 | A | 7/1950 | Marasco | |
| 4,019,763 | A * | 4/1977 | Webb, Sr. | B04B 7/06 292/144 |
| 5,107,731 | A * | 4/1992 | Kent | B26D 3/28 83/77 |
| 7,146,896 | B2 | 12/2006 | Chang | |
| 7,185,583 | B2 | 3/2007 | Berglin et al. | |
| 2005/0076787 | A1 * | 4/2005 | Grant | A47J 31/3676 99/279 |

(Continued)

OTHER PUBLICATIONS

International Search and Written Opinion of the International Searching Authority for PCT Application No. PCT/US2015/021201 dated Jul. 15, 2015.

*Primary Examiner* — Stephen Choi

(74) *Attorney, Agent, or Firm* — Charles F. Reidelbach, Jr.

(57) ABSTRACT

An automated food processing machine receives a whole fruit or vegetable and presses it through a blade set to form slices or wedges. The machine includes a controller coupled to various components including linear motion actuators, a user interface, and sensors. One motion actuator coupled to a slitting blade. Another motion actuator is coupled to a ram. In response to an input the controller activates the motion actuators in a sequence including (1) linear motion of the slitting blade to form a slit in the whole fruit or vegetable and (2) linear motion of the ram to press the whole fruit or vegetable through a blade set to form the slices or wedges.

22 Claims, 19 Drawing Sheets

(56) References Cited

U.S. PATENT DOCUMENTS

| | | | | |
|---|---|---|---|---|
| 2012/0177790 | A1* | 7/2012 | Tuchrelo | A47J 17/14<br>426/231 |
| 2014/0065275 | A1 | 3/2014 | Hoffman et al. | |
| 2014/0087048 | A1* | 3/2014 | Webster | A21C 9/04<br>426/518 |

* cited by examiner

AUTOMATED MACHINE FOR SLITTING AND WEDGE CUTTING WHOLE FRUITS AND VEGETABLES

FIELD OF THE INVENTION

The present disclosure concerns motorized food processing equipment. More particularly the present disclosure describes a machine for automatically slitting and wedging a whole fruit or vegetable.

BACKGROUND

Hand cutting wedges of whole fruits or vegetables is a common practice in food establishments. In some establishments there is a need to prepare large numbers of cut lemons or limes to accompany food and drinks. For drinks in particular there is a need to cut wedges and then slit the wedges to allow them to be placed onto drinking containers. Such a wedge is illustrated with respect to FIG. 5C which illustrates a cut fruit wedge 32 with slit 38 for placing the fruit wedge 32 onto the side of a drinking cup or glass.

Preparing such fruit wedges can be labor intensive and repetitive. Such repetitive food preparation, involving sharp knives, can result in both repetitive and cut related injury. Some manually actuated wedge cutting tools have been introduced to reduce required labor and a chance of injury. Besides being manual, currently available tools generally don't provide the slit 38. There is a need for a better solution that enables preparation of many slit fruit wedges 32 while reducing labor and a chance of injury in the preparation process.

DETAILED DESCRIPTION OF THE PREFERRED EMBODIMENTS

Figure 1:
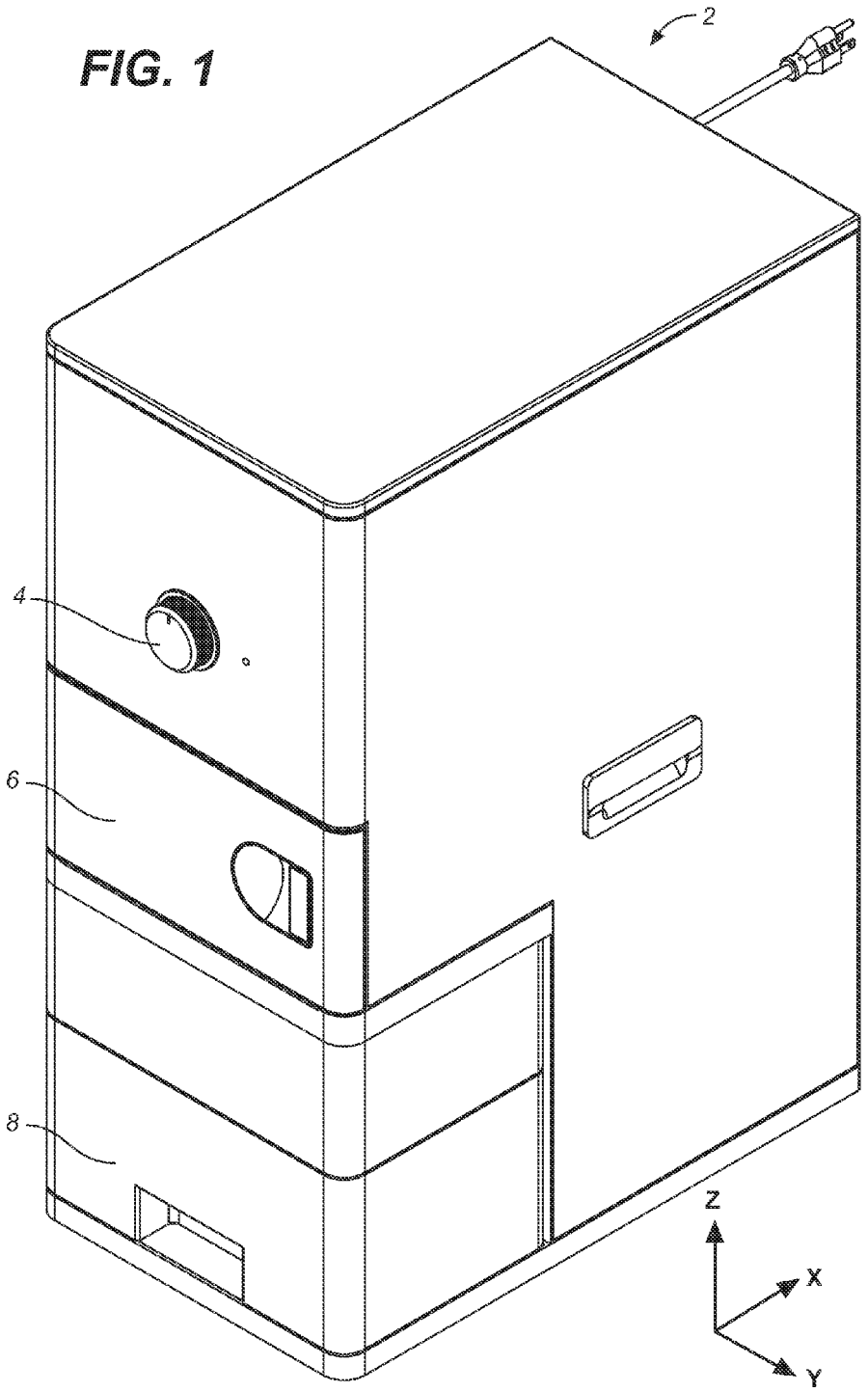
FIG. 1 is an isometric view of a food processing machine for slitting and wedging a whole fruit.

Described herein is a food processing machine and associated method for processing a whole fruit or vegetable. Throughout the description, the object to be processed will be described as a "whole fruit," but it is to be understood that the object to be processed can be any suitable fruit or vegetable such as a lemon, lime, orange, or tomato, just to name a few examples. The whole fruit is generally has a rounded convex outer surface that may be partially spherical or ellipsoidal in form. In terms of geometry, we may refer to a "polar axis" passing through the center of the fruit and a "bisecting plane" that is perpendicular to the polar axis that approximately bisects the fruit. The intersection of the plane with the rounded outer surface of the fruit may be called the "equator" of the whole fruit. These terms are here presented to facilitate an understanding of the operation of a food processing machine on the fruit but are not meant to accurately represent the geometry of the fruit. The machine of the present invention can effectively operate on some irregularly shaped fruits and vegetables for which the polar axis, bisecting plane, and equator are difficult to define.

In an exemplary embodiment, a food processing machine is configured to operate in two different modes which are described below. In a second embodiment, the food processing machine is configured to operate in only one of the two different modes described below. A mode can include one or more operations. One such operation can be described as slitting whereby a fruit receives a slit that results in the slit 38 of FIG. 5. Another such operation can be described as wedging whereby a whole fruit is cut into wedges 32 of FIG. 5 with or without slit 38.

The food processing machine of the present invention is automated whereby the automation is enabled by an electronic control system. The electronic control system receives an input and then automatically performs an operating mode in response. The input can actually be one electrical pulse signal such as a signal imparted by pressing a button or it can be multiple signals from different sources such as from sensors and a button.

In a first operating mode the food processing machine performs a wedging operation. First, the machine receives a whole fruit in a receptacle. The user then closes a cover or door on the machine. In response to an input, the machine automatically presses the whole fruit into a blade set whereby the whole fruit is cut into wedge sections without slits. Each wedge section has a rounded outer surface and flat cut surfaces that converge to form a wedge apex edge.

In an alternative first operating mode, the food processing machine cuts a fruit or vegetable into portions having geometries other than wedges. The cross-sectional geometry depends upon the geometry of the blade set. Other geometries may be rectangular, square, or have curved cut surfaces as may be appropriate for the application.

In a second operating mode, the food processing machine performs a sequence of operations including a slitting operation followed by a wedging operation in response to receiving an input. The slitting and wedging operations are preformed along substantially perpendicular axes. The slitting is performed by a blade that passes through the equator and past the center of the fruit. The blade is approximately parallel to and coincident with the bisecting plane. After the slitting is performed the machine pushes the whole fruit through a fixed blade set along the polar axis which is perpendicular to the motion of the slitting blade. The result are fruit sections that each having rounded outer surface, flat cut surfaces forming a wedge apex edge, and a slit formed in the wedge apex edge. In the second operating mode, the fruit sections are ready to be pressed onto a glass holding a beverage.

FIG. 1 depicts an isometric view of a food processing machine 2 including a user interface 4, access door 6, and receiving drawer 8. The user interface 4 may includes a dial that allows a user to choose an operating mode for machine 2. In a exemplary embodiment the user can utilize the user interface 4 to select between two different operating modes including a first mode and a second mode. In the first operating mode, machine 2 will automatically cut a whole fruit into wedges without first slitting the whole fruit. In the second operating mode, machine 2 will automatically perform a sequence of operations including slitting the whole fruit and then cutting the fruit into wedges.

While user interface 4 is depicted as having a dial, it can have other features such as buttons, membrane switches, multiple dials, indicators, and other user interface features. User interface 4 can include a start switch that provides an input for initiating an operating mode.

Figure 2:
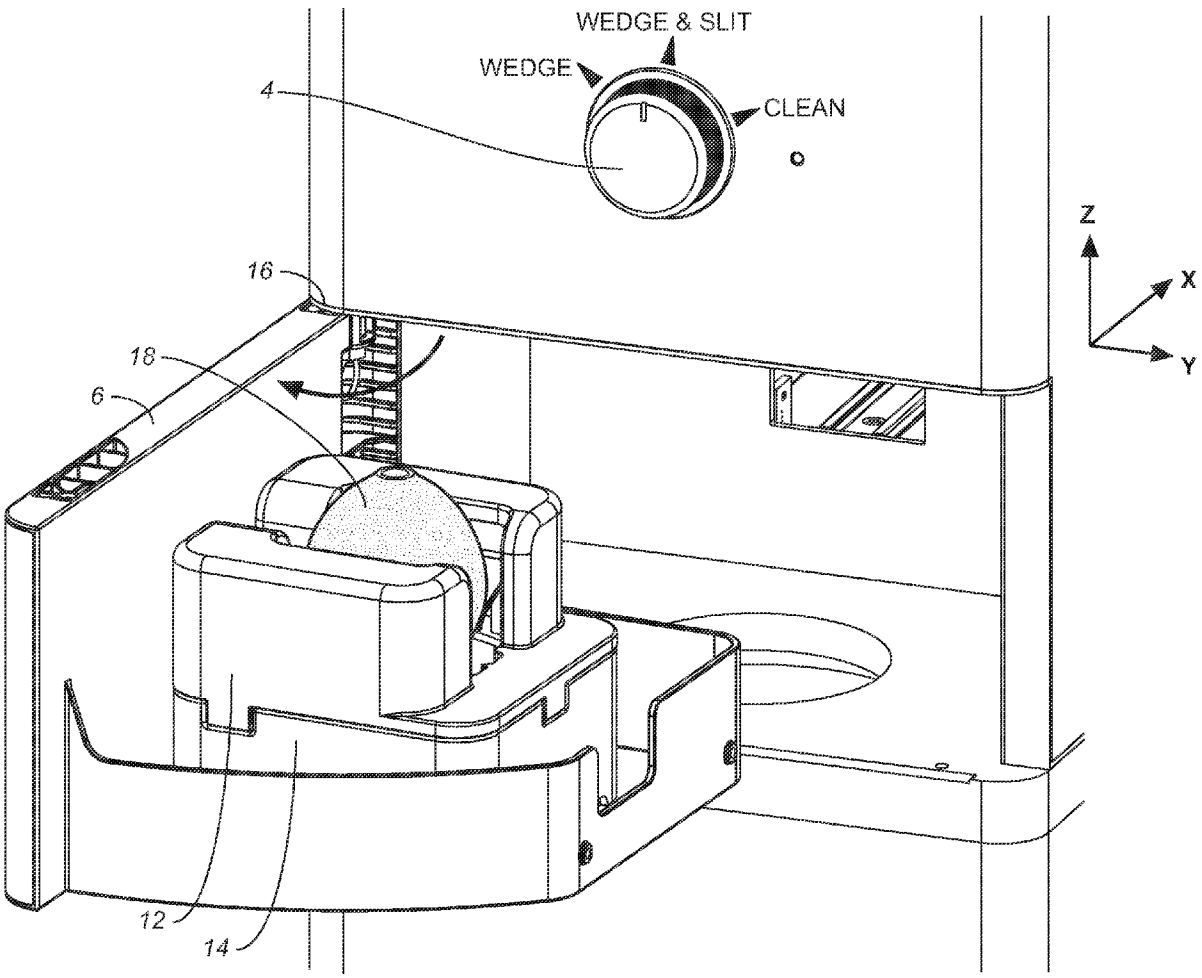
FIG. 2 is an isometric view of a portion of a food processing machine for slitting and wedging a whole fruit with an access door open to illustrate loading of the whole fruit and various components.

The access door 6 allows a user to load the whole fruit into the machine before processing and, optionally, to access certain user-serviceable or cleanable portions of machine 2. FIG. 2 depicts a portion of machine 2 with access door 6 open. Integrated into access door 6 is receptacle 12 and blade set 14 below receptacle 12.

Door 6 swings about hinge 16 to allow a user to open and close door 6. Within receptacle 12 is whole fruit 18. Having receptacle 12 and blade set 14 integrated together has the advantage that their total Z-height can be minimized and that they are precisely aligned so that fruit 18 is automatically aligned to blade set 14. Having receptacle 12 and blade set 14 integrated into door 6 is advantageous because closing the door 6 automatically aligns the receptacle 12 and blade set 14 with machine 2.

In an alternative embodiment door 6 is a drawer-style door 6 configured to slide in and out of the machine 2 along the X-axis. Sliding drawer-style door 6 out toward a user opens the door 6 and sliding drawer-style door 6 into a closed position aligns the receptacle 12 and blade set 14 with the machine 2.

Near the base of machine 2 is a receiving drawer 8 that receives fruit wedges that have been automatically cut by machine 2 (FIG. 1). Within drawer 8 a bowl or other container may be placed for receiving the cut wedges.

In use the following is a exemplary operating sequence: (1) The user selects an operating mode with user interface 4. Machine 2 thereby receives an operating mode setting. (2) The user opens door 6 by swinging door 6 about hinge 16 to an open state as depicted in FIG. 2. (3) The user places hole fruit 18 into receptacle 12. Receptacle 12 is configured to align whole fruit 18 with blade set 14. (4) The user swings door 6 about hinge 16 to a closed state as depicted in FIG. 1. In an exemplary embodiment, closing door 6 activates a sensor which enables operation of machine 2. (5) The machine 2 receives an input to begin operation. The input may be from user interface 4, such as in response to pushing a button, or it can be in response to the sensor that detects door closure. (6) The machine automatically performs the slitting operation (depending on the operating mode selected). (7) The machine performs the wedging operation by pushing the whole fruit from receptacle 12 and through blade set 14. Resultant fruit wedges fall into drawer 8. (8) The user opens drawer 8 and removes the resultant fruit wedges.

Figure 3:
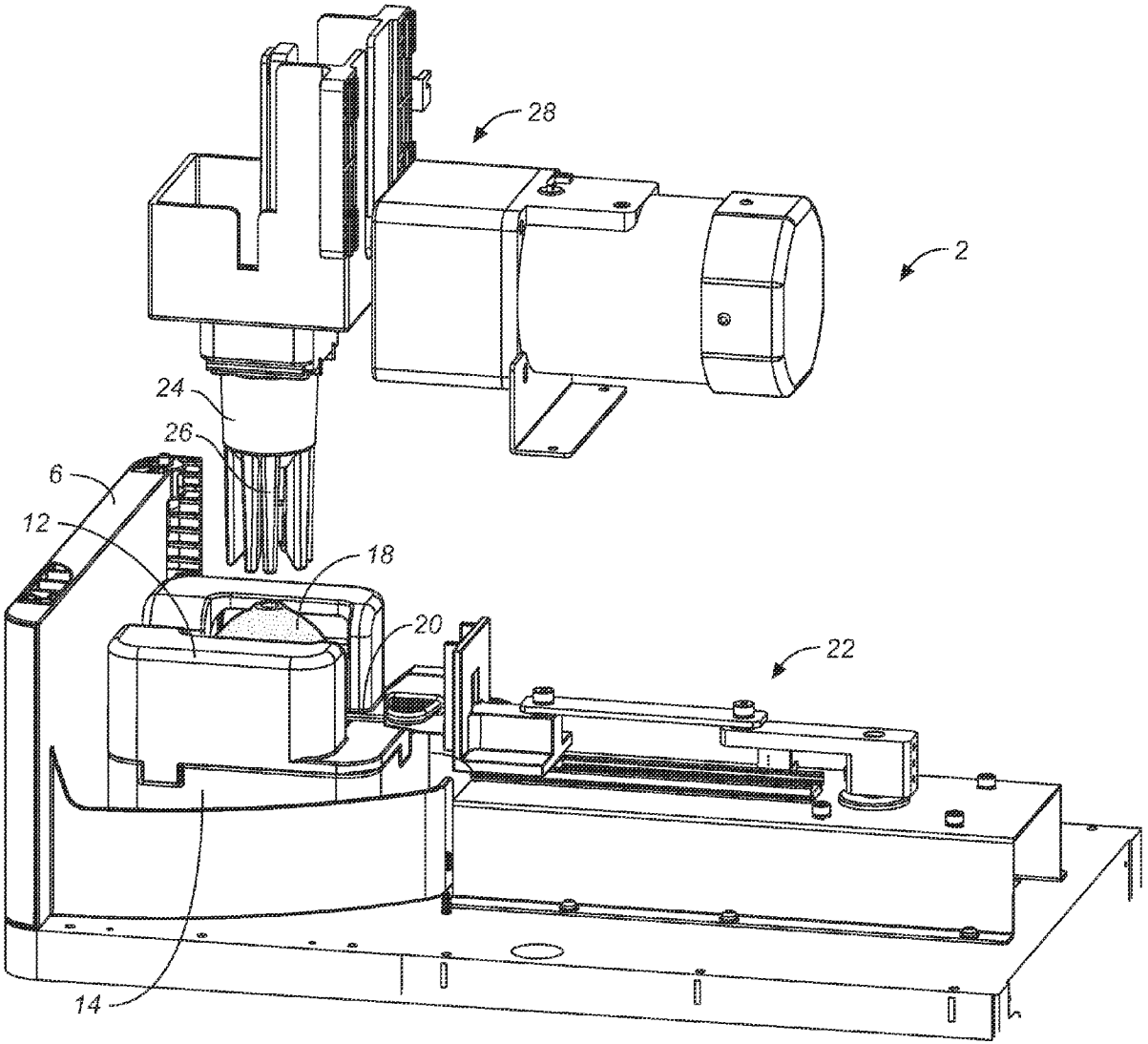
FIG. 3 is an isometric view of certain components of a food processing machine for slitting and wedging a whole fruit.
Figure 3:
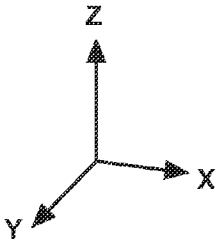

FIG. 3 depicts a portion of food processing machine 2 with some outer coverings removed to enable viewing of some machine parts. Axes X, Y, and Z are herein used to describe directions in machine 2. Generally speaking these axes are mutually orthogonal but not necessarily aligned with any particular reference such as a gravitational reference. Nevertheless, we will refer to the X-axis and Y-axis as horizontal or lateral axes and the Z-axis as a vertical axis for convenience. In the illustrated embodiment: The X-axis is a front to back axis as the machine is viewed from the front by a user (see also FIG. 1). The Y-axis is from left to right as viewed by the user. The Z-axis is vertical relative to the user. It is to be understood that re-orienting the machine such that the three axes are oriented differently relative to a gravitational reference and the user is possible without substantially changing the function of the machine 2.

Machine 2 includes slitting blade 20 that is mechanically coupled to motion actuator 22. Motion actuator 22 is constrained to move slitting blade 20 along the X axis to provide a slit through the equator of the fruit 18 and just past its center.

Machine 2 includes ram 24 with downwardly extending fingers 26 that is mechanically coupled to motion actuator 28. Fingers 26 extend along the Z-axis and are configured to push whole fruit 18 from receptacle 12 and through blade set 14. Actuator 28 is constrained to move ram 24 along the Z-axis.

As is apparent in FIGS. 2 and 3, the closure of door 6 aligns the receptacle 12 and blade set 14 with ram 24. This is important to assure that fingers 26 are aligned with blade set 14 as will become more apparent in later discussion. Fingers 26 also include chamfered tips that facilitate close alignment between the fingers 26 and the blade set 14.

Figure 4A:
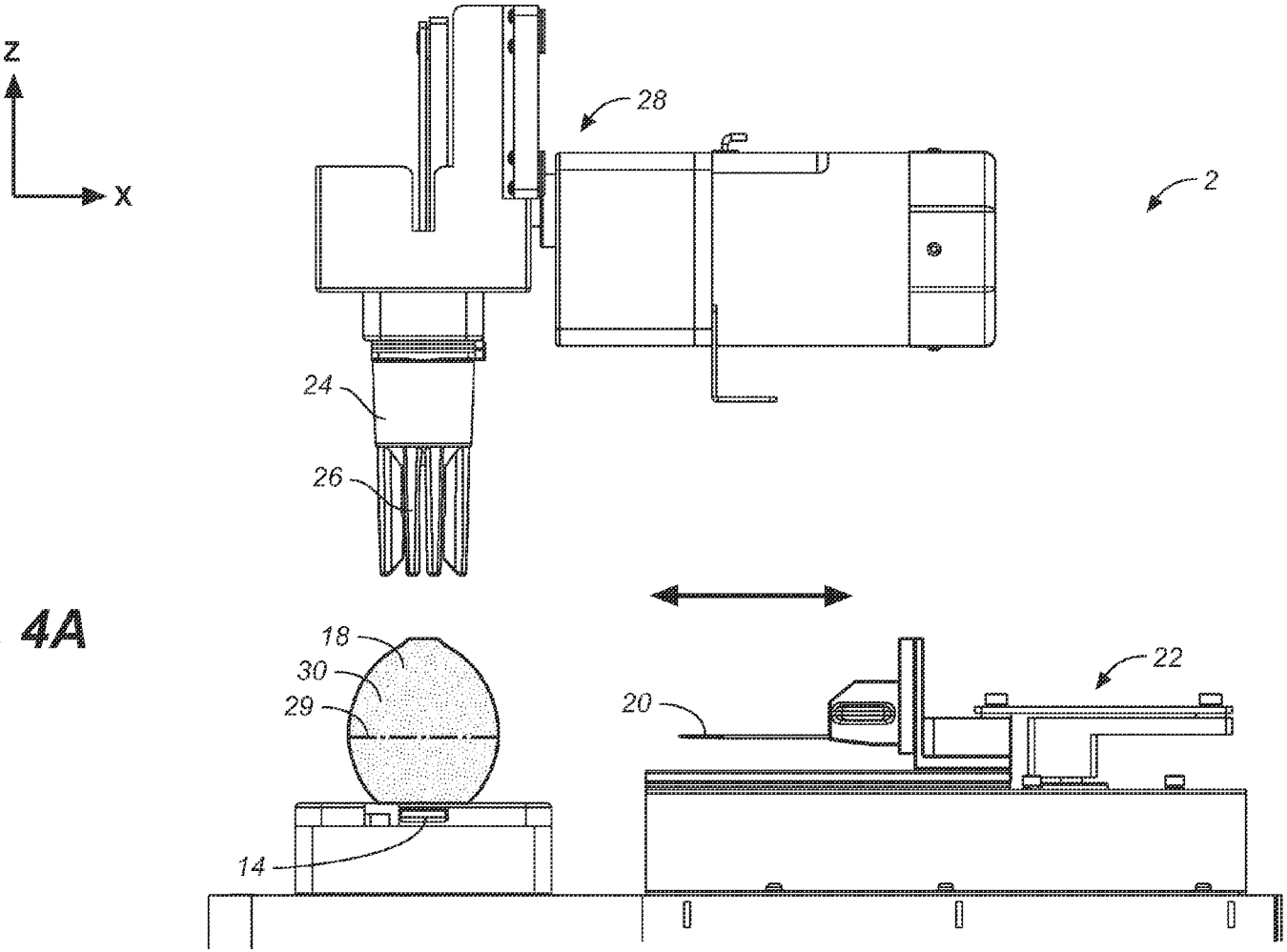
FIG. 4A is a side view of a food processing machine for slitting and wedging a whole fruit illustrating a starting position.

FIGS. 4A-D depict operation of machine 2 during the operating mode of slitting and wedging whole fruit 18. Not shown in FIGS. 4A-D is receptacle 12 which holds the whole fruit 18 in alignment. The initial state before the process is depicted in FIG. 4A whereby whole fruit 18 is positioned and aligned above blade set 14 and below fingers 26 of ram 24. The "equator" 29 of whole fruit 18 is aligned with the X-motion of slitting blade 20. Equator 29 is defined by the intersection of a horizontal plane that roughly bisects whole fruit 18 and an outside surface 30 of whole fruit 18. After the initial state as depicted in FIG. 4A the machine 2 sequentially executes the steps of slitting and wedging.

Figure 4B:
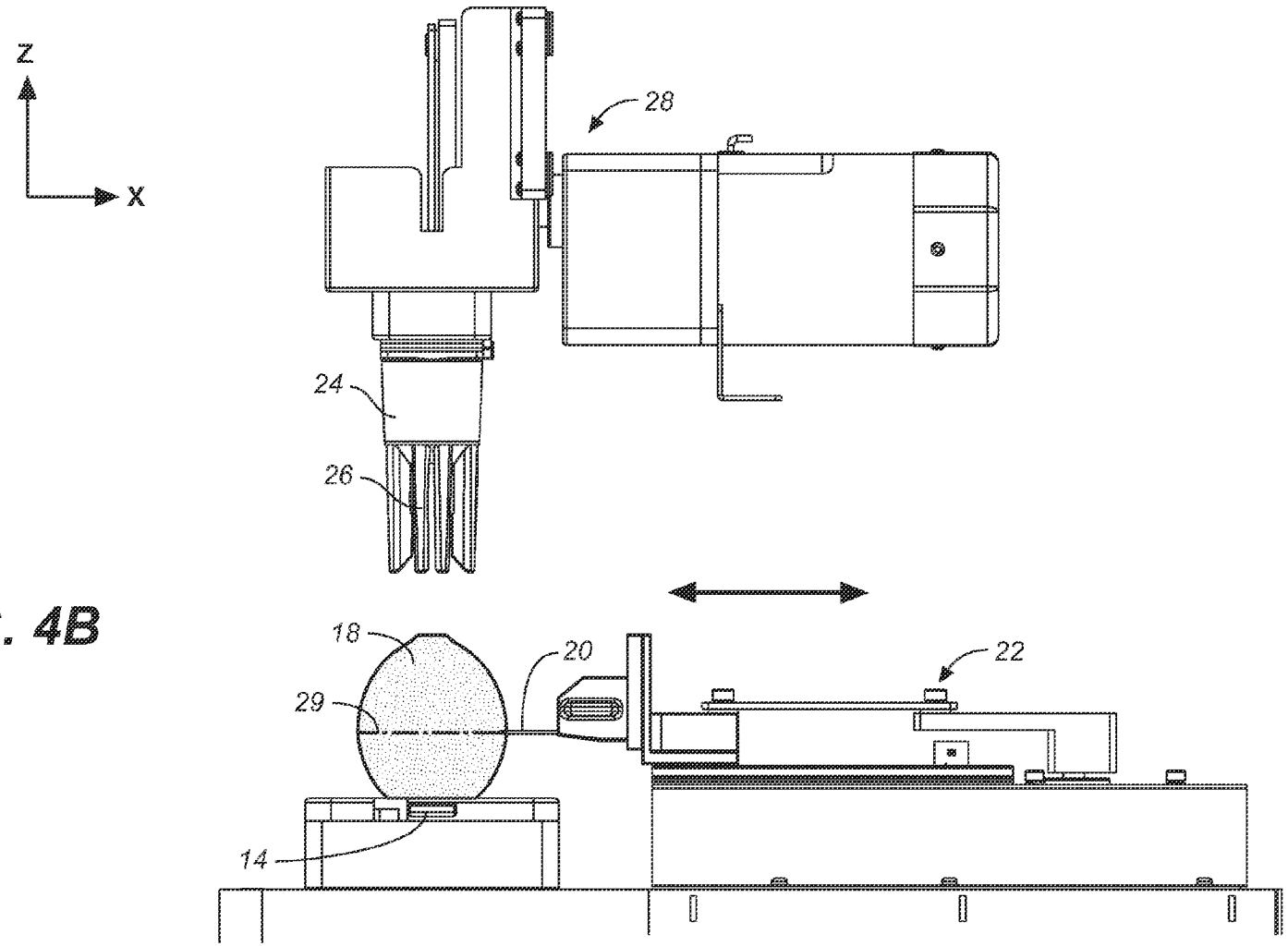
FIG. 4B is a side view of a food processing machine for slitting and wedging a whole fruit illustrating the slitting operation.

FIG. 4B depicts the slitting operation whereby motion actuator 22 moves blade 20 along the X-axis. Blade 20 pierces whole fruit 18 along equator 28 and leaves a cut extending just past a center of whole fruit 18.

Figure 5A:
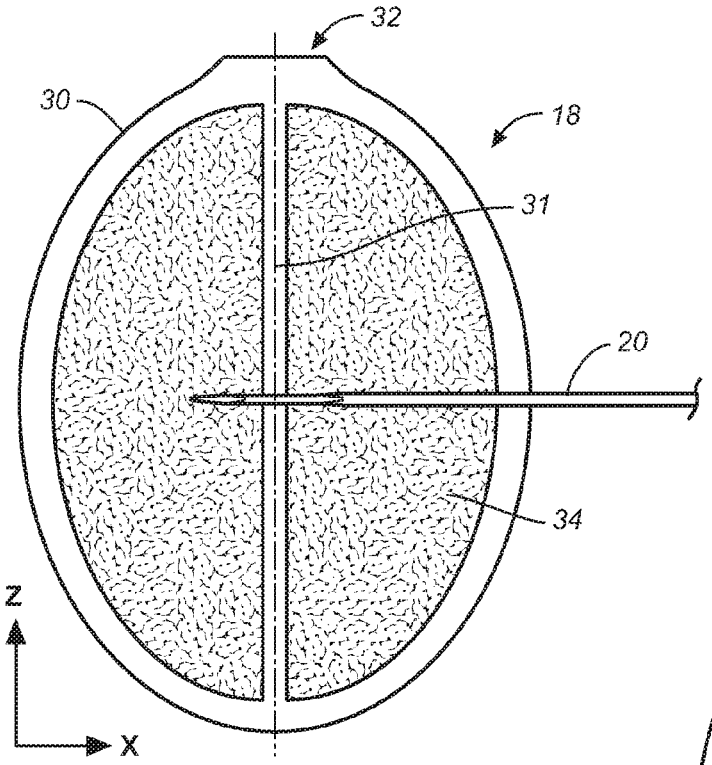
FIG. 5A is a side sectional view of a whole fruit during a slitting operation.
Figure 5C:
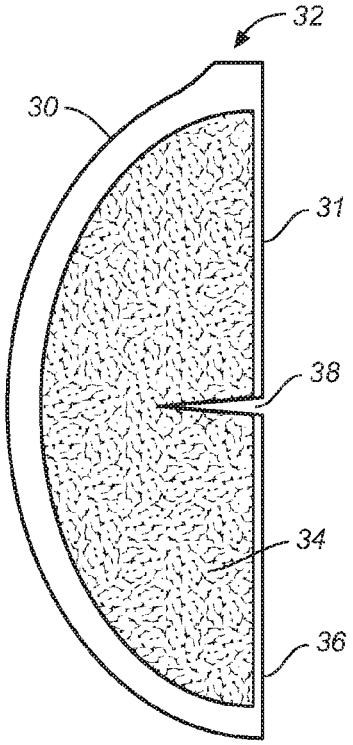
FIG. 5C is a side view of a wedge of fruit resulting from a slitting and wedging mode of operation.
Figure 5B:
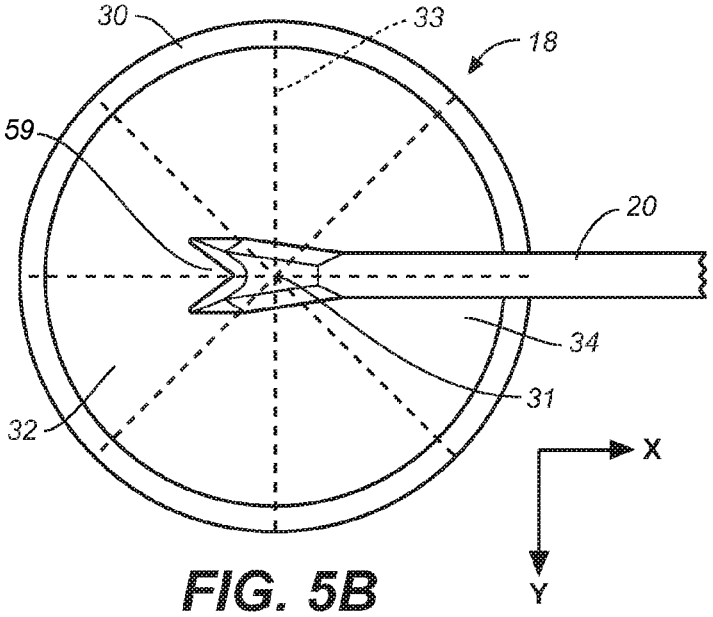
FIG. 5B is a top sectional view of a whole fruit during a slitting operation.

FIGS. 5A and 5B depict the slitting operation of whole fruit in cut-way side and top views respectively. FIG. 5A depicts whole fruit 18 with outside surface 30 with centerline 31 that corresponds to a center of the blade set 14. The slitting blade 20 pierces the outside surface 30 and passes into the fruit until a slit is formed past the centerline 31. In an exemplary embodiment, the cut passes at least 0.1 inches past the centerline 31. In another embodiment the cut passes at least 0.2 inch past the centerline 31. In yet another embodiment the cut passes the centerline 31 for a distance in the range of 0.2 to 0.3 inch. In yet another embodiment the cut passes about 0.25 inch past centerline 31. Other cut depths are possible depending on factors such as the overall dimensional size of whole fruit 18 along the slitting axis X.

FIG. 5B depicts whole fruit 18 with outside surface 30 and vertical section lines 33 that separate wedges 32. Vertical section lines correspond to the cuts to be made by the blade set 14. It is advantageous that slitting blade 20 is aligned with a vertical section line 33 so that the slitting cut spans two wedges 32. This is advantageous because the cut in any single wedge 32 is minimized. Otherwise the slitting operation might undesirably split a single wedge 32 into two pieces.

Figure 4C:
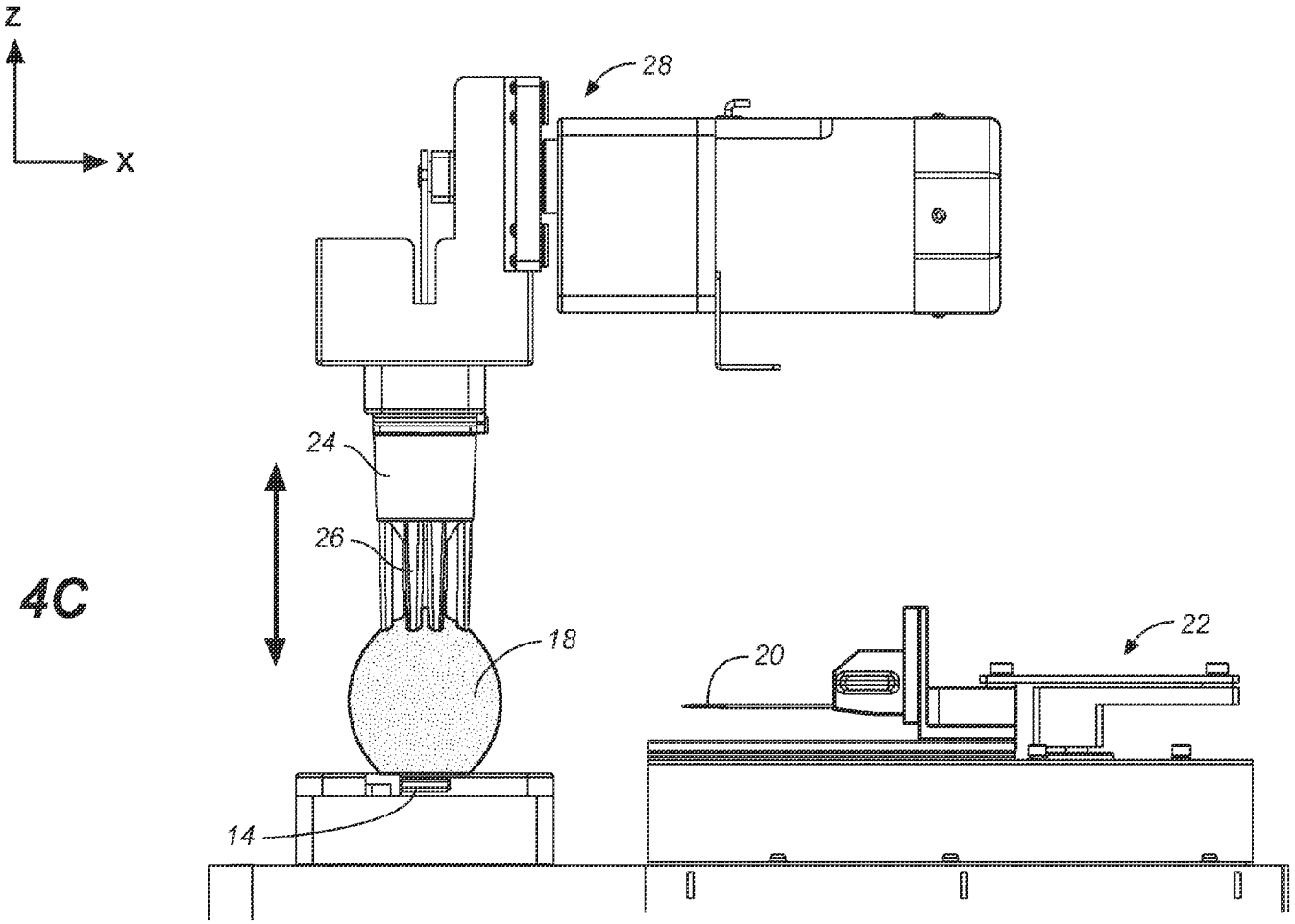
FIG. 4C is a side view of a food processing machine for slitting and wedging a whole fruit illustrating motion during the start of a wedging operation.

According to FIG. 4C, motion actuator 22 has withdrawn slitting blade 20 from whole fruit 18. Motion actuator 28 has moved ram 24 downwardly in axis Z direction until fingers 26 have contacted and displaced whole fruit 18 downwardly in the Z axis direction. Whole fruit has been pushed down through receptacle 12 (not shown in FIG. 4C) and into contact with blade set 14.

Figure 4D:
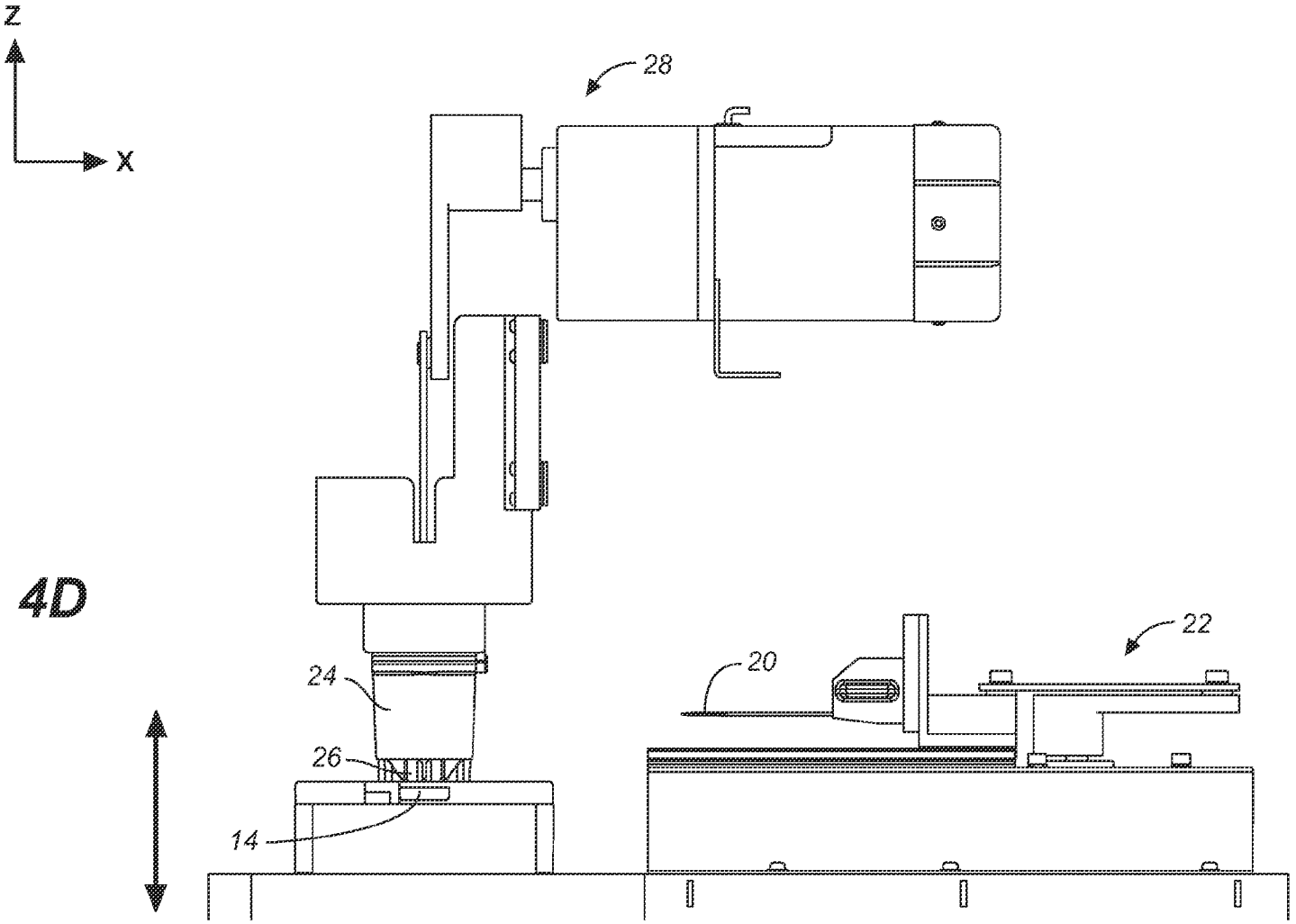
FIG. 4D is a side view of a food processing machine for slitting and wedging a whole fruit illustrating completion of a wedging operation.

According to FIG. 4D, motion actuator 28 has moved ram 24 downwardly in Z axis direction so that fingers 26 have pushed through openings in blade set 14. Being pushed through the blade set 14, the whole fruit is now in wedge sections 32. One such wedge section 32 is depicted in FIG. 5C. Wedge section 32 has outer surface 30 and planar cut surfaces 34 that meet to define an apex edge 36. At approximately the center point of apex edge 36 is slit 38 that has been cut by blade 20.

Figure 6A:
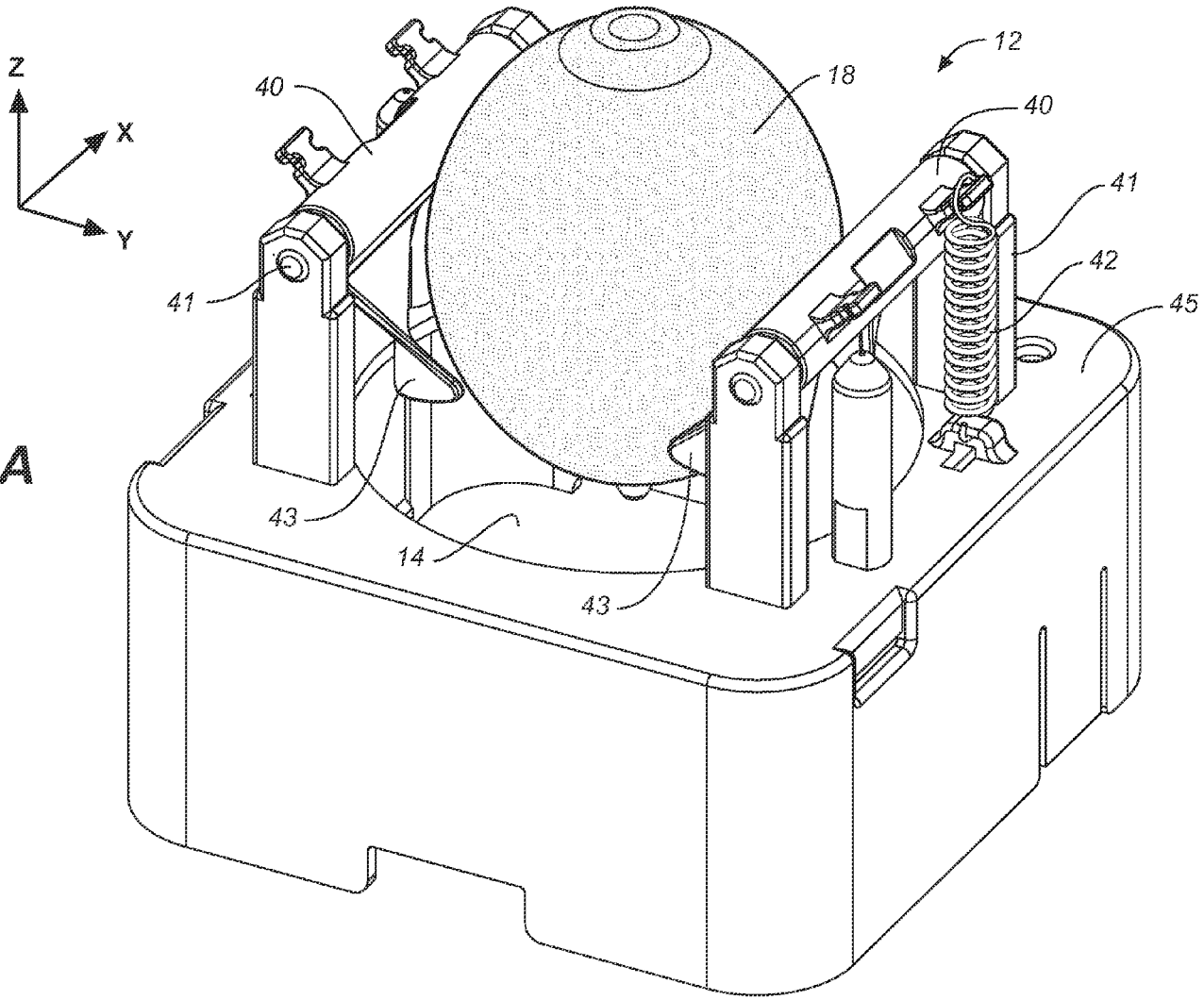
FIG. 6A is an isometric view depicting details of a receptacle for receiving a whole fruit.

FIG. 6A depicts receptacle 12 in greater detail with whole fruit 18 positioned therein. Receptacle 12 includes opposing levers 40 that are urged inwardly by springs 42. Levers 40 exert a laterally inward force upon whole fruit 18 in a direction that is generally orthogonal to axis Z. In an exemplary embodiment, levers 40 exert a force that is along an axis Y that is mutually orthogonal to axes X and Z. The levers 40 impinging upon whole fruit 18 provide static friction that resists motion along the X-axis. This static friction allows levers 40 to hold the fruit in place during the slitting operation illustrated in FIG. 4B. Levers 40 thereby hold and maintain the whole fruit 18 in alignment with blade set 14.

Figure 6B:
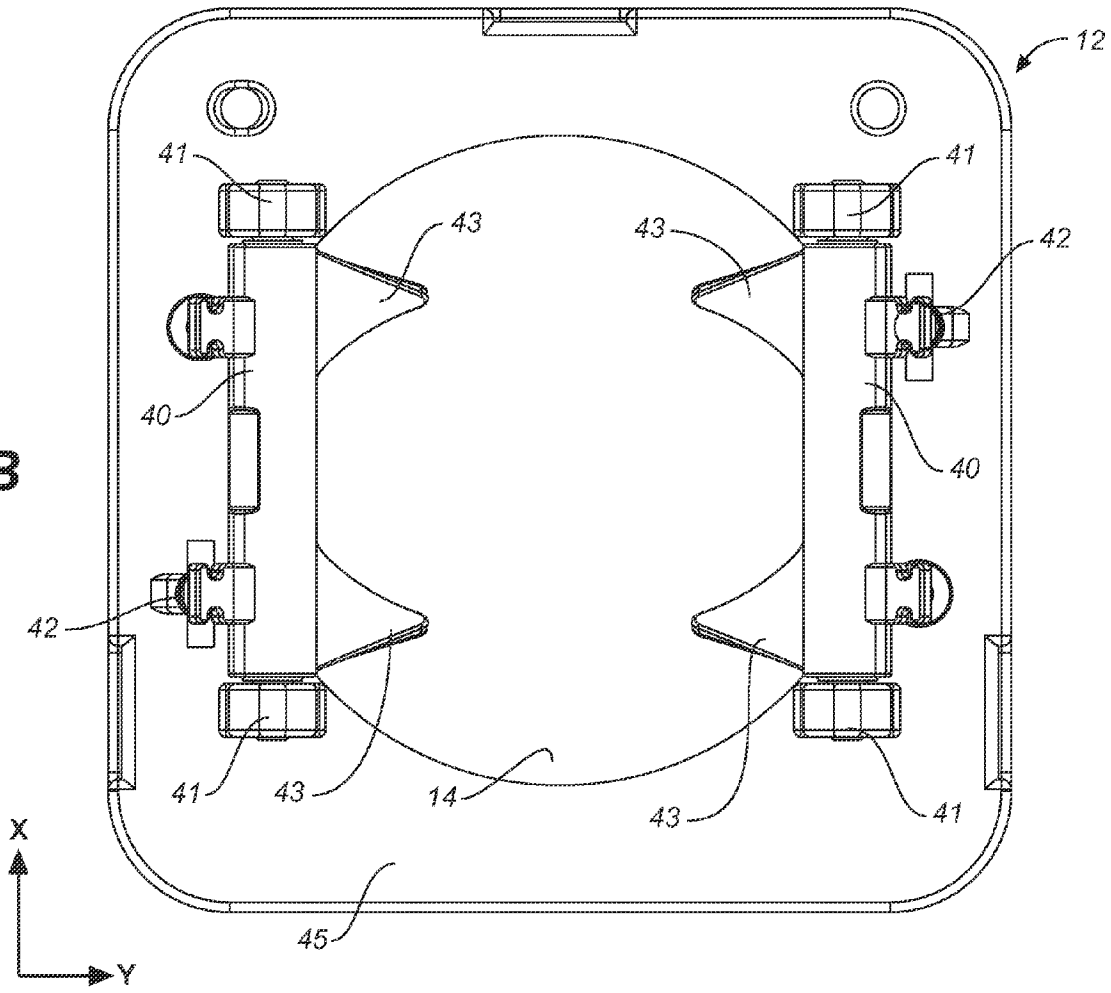
FIG. 6B is a top view depicting details of a receptacle for receiving and maintaining alignment of a whole fruit.
Figure 6C:
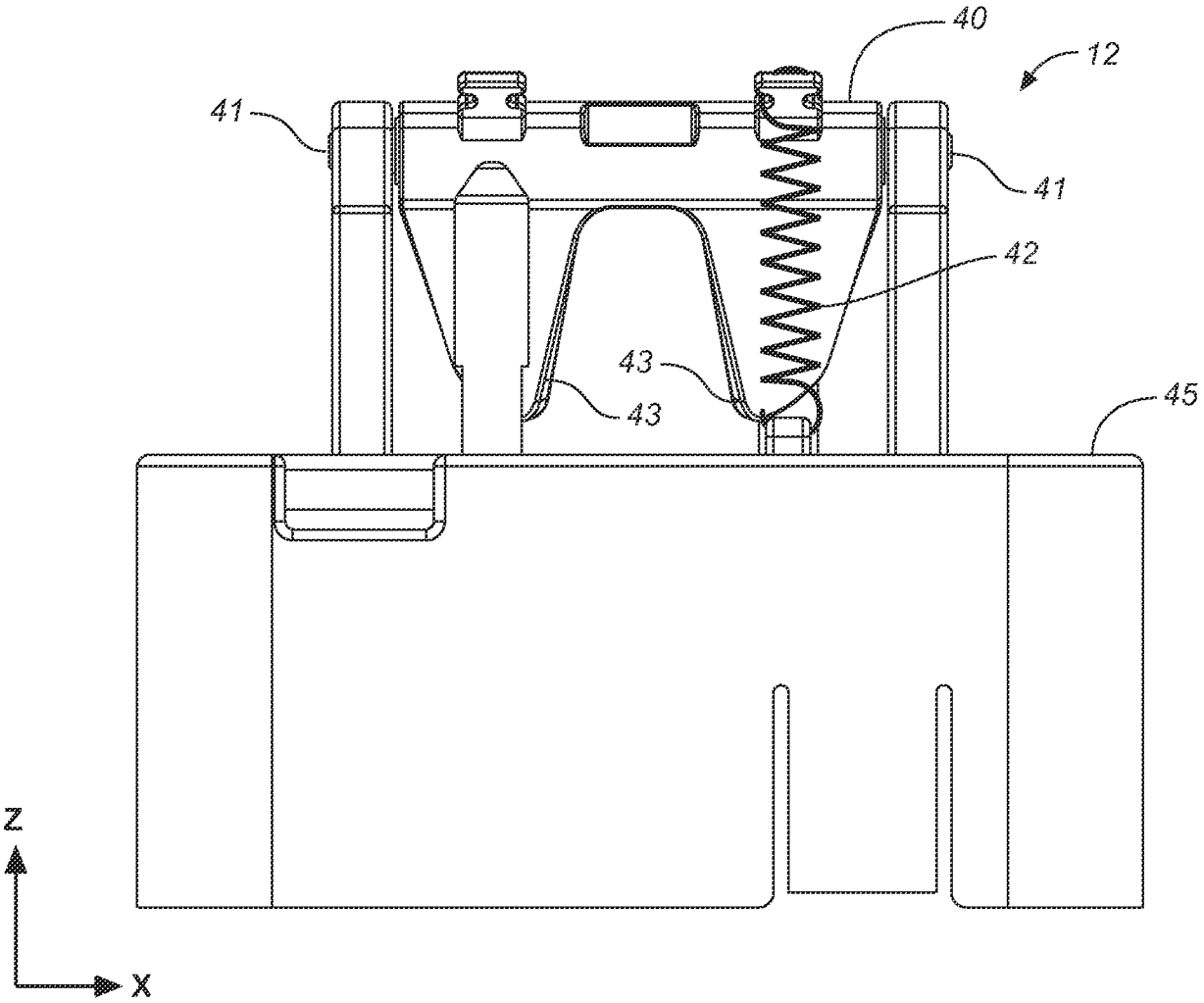
FIG. 6C is a side view depicting details of a receptacle for receiving and maintaining alignment of a whole fruit.

FIGS. 6B and 6C are top and side views of receptacle 12 depicting more details particularly concerning the levers 40. Each lever 40 is rotatingly mounted to two posts 41 that are supported on base 45. Posts 41 are on opposing sides of each lever 40 with respect to the X-axis. Each lever 40 rotates an axis defined between two posts 41 that is parallel to the X-axis. Importantly each lever 40 has a bifurcated design whereby each lever 40 has two extensions or tips 43 that are arranged along the X-axis. The fruit 18 is therefore held in four locations by four extensions 43 of the two levers 40. The extensions 43 bear inwardly along the Y direction upon the outside of whole fruit 18 and each provide X and Y force components to whole fruit 18 which maintain alignment between whole fruit 18 and blade set 14. Extensions 43 prevent fruit 18 from being moved out of alignment along the X-axis by the action of slitting blade 20.

For certain geometries of fruits and vegetables the independently moving levers 40 may align the fruit 18 somewhat off-center relative to the centerline 31 of blade set 14. Then the wedges 32 produced by machine 2 might be varying in size. This is particularly likely for an asymmetrical whole fruit 18. To better accommodate varying whole fruit 18 geometries the levers 40 can be constrained to the same degree of inward rotation. To provide this constraint a constraining apparatus (not shown) such as a linkage or gear train can couple movement of one lever 40 to the movement of the other lever 40 so that the two levers 40 rotate inwardly and outwardly by the same amount except for any mechanical slop in the linkage or gear train. The constraining apparatus can include a combination of wires, gears, and/or mechanical links. One example of such a constraining apparatus would be a three gear system with a gear rotating with each lever and coupled to a central gear. Another such constraining apparatus would include a wheel rotating with each lever with a wire coupling them in an under and over arrangement. In each case the angular rotation of the levers would be constrained to be opposing and substantially equal in magnitude.

Figure 7A:
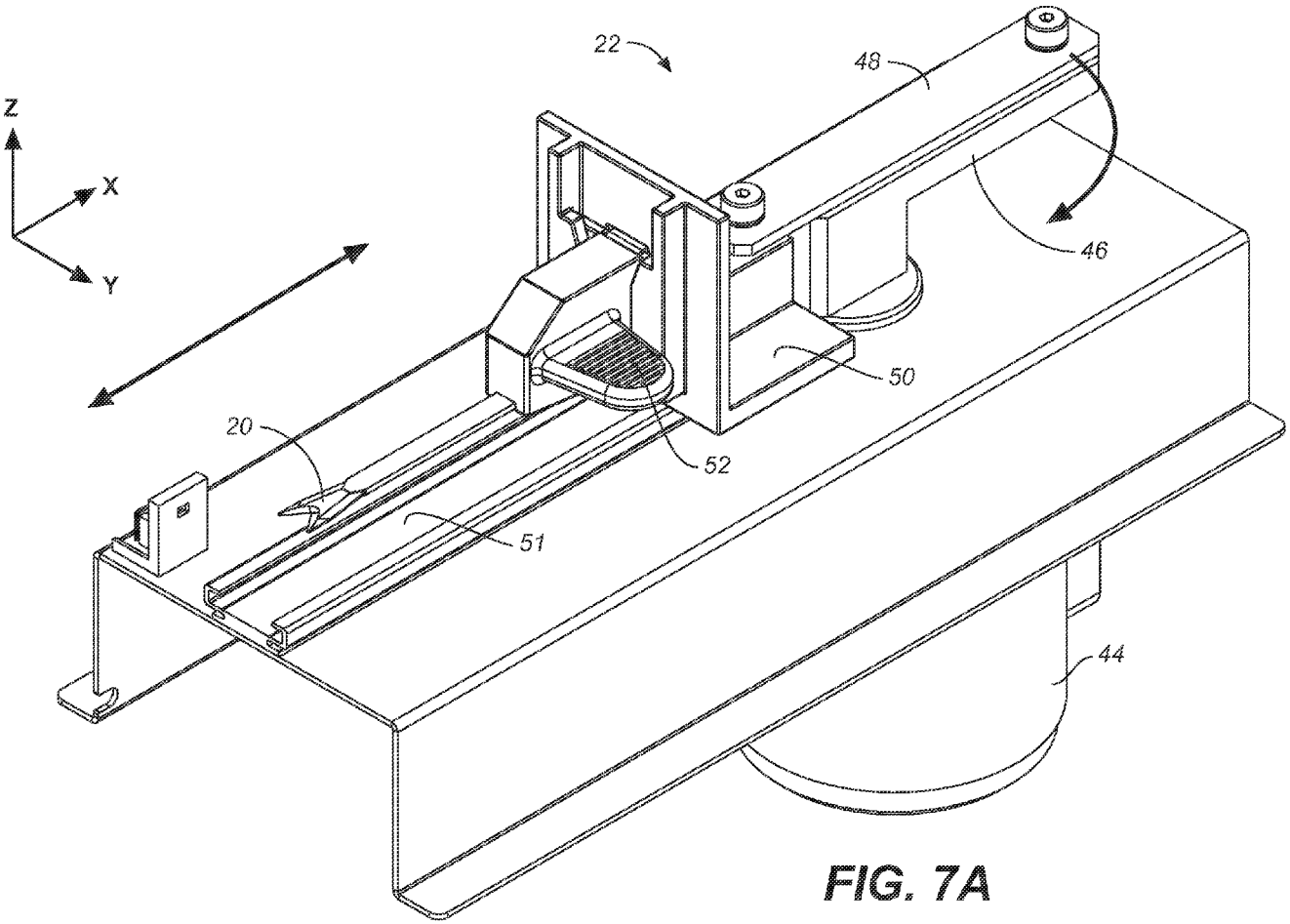
FIG. 7A is an isometric view depicting details of a motion actuator coupled to a slitting blade in a retracted position.
Figure 7B:
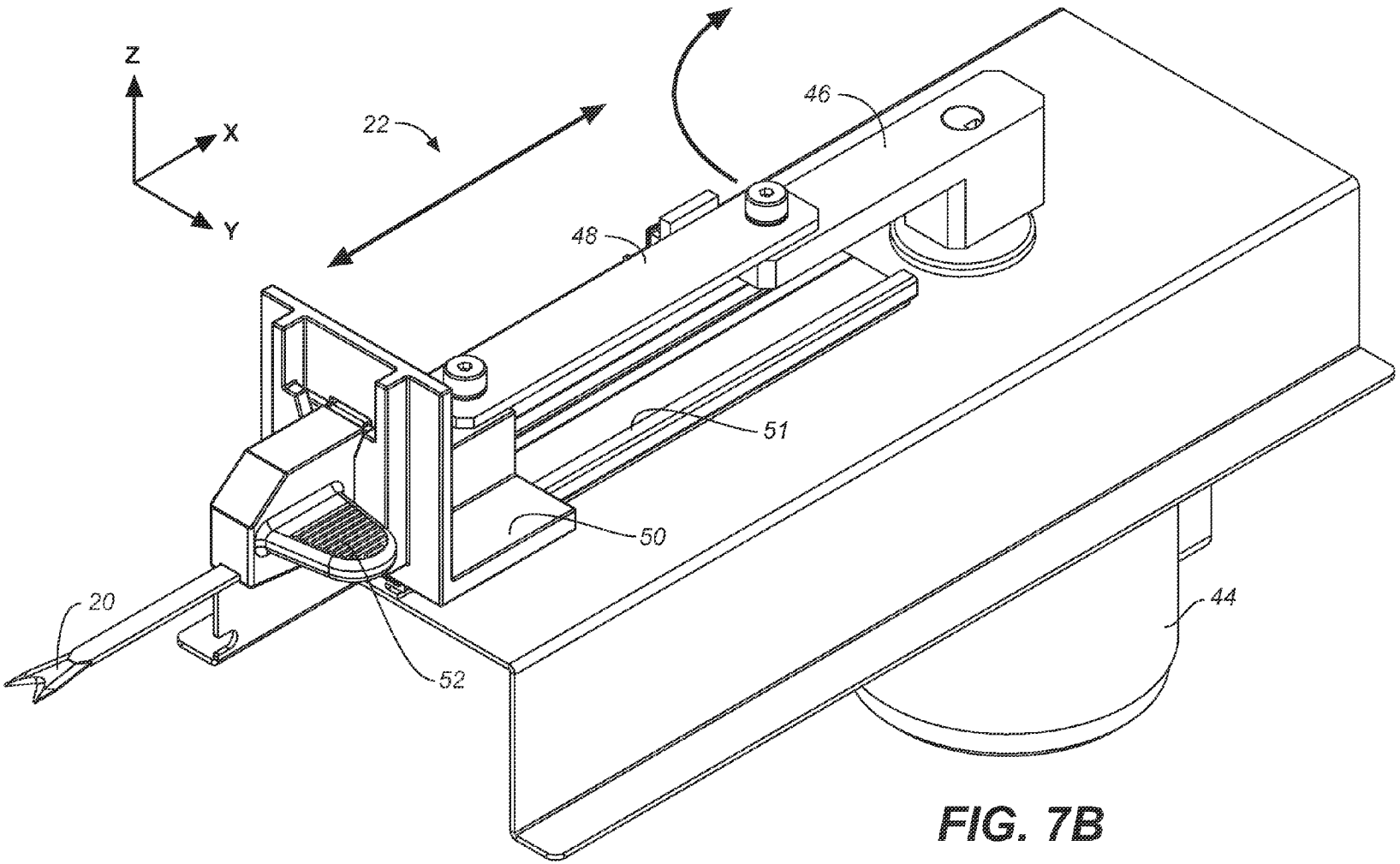
FIG. 7B is an isometric view depicting details of a motion actuator coupled to a slitting blade in an extended (slitting) position.

FIGS. 7A and 7B are isometric views depicting motion actuator 22 coupled to slitting blade 20. Motion actuator 22 includes a motor 44 coupled to a turning arm 46 and link 48. As motor 44 turns arm 46 in a circular motion, the link 48 controllably pushes and pulls on linear slider 50 which moves back and forth along slide 51. Blade 20 is mounted to slider 50 via a handle 52. Handle 52 can be lifted up along the Z-axis and off slider for cleaning or replacement.

FIG. 7A depicts slitting blade 20 in a fully retracted (starting) position before slitting a whole fruit 18. Arm 46 is shown oriented away from the receptacle 12 and hence slider 50 is fully retracted along slide 51. FIG. 7B depicts slitting blade 20 in a fully extended (slitting) position. The arm 46 is now oriented toward the receptacle 12 and hence slider 50 is advanced toward receptacle 12 (FIG. 3) along slide 51.

Figure 7C:
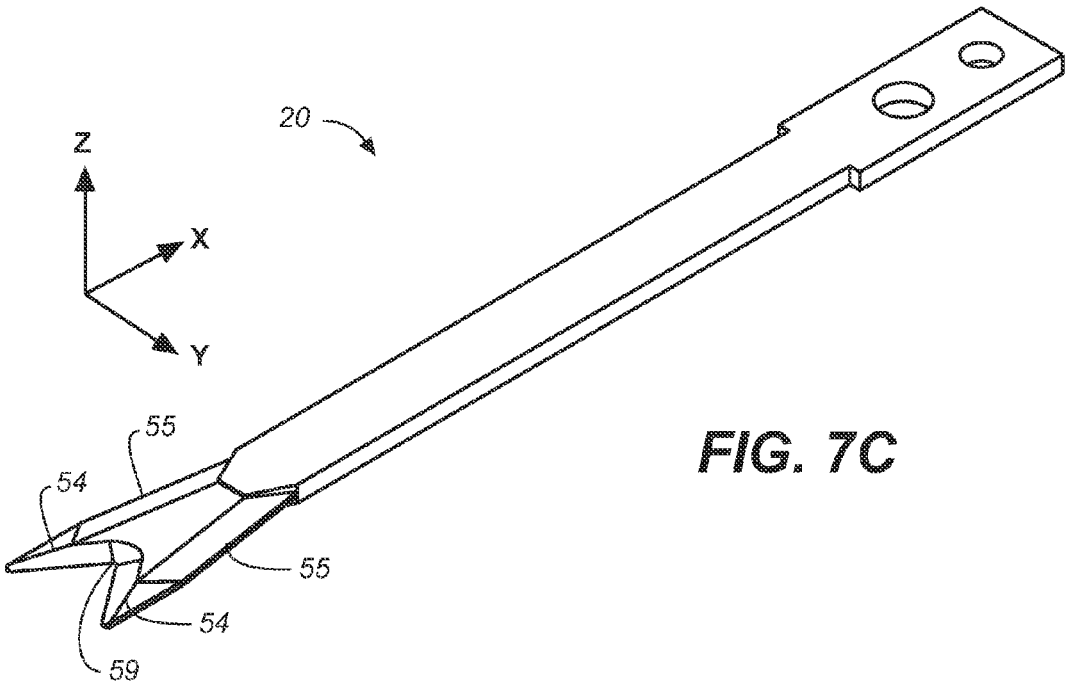
FIG. 7C is an isometric view of a slitting blade.

FIG. 7C is an isometric view depicting slitting blade 20 in detail. Slitting blade 20 has a bifurcated end including a central notch 59 from which two tips 54 extend. The two tips 54 are spaced apart along axis Y that is perpendicular to the direction of slitting X. This bifurcated design improves the quality of the cut by capturing the fruit meat 34 in notch 59 as the blade passes into the fruit as is illustrated in FIG. 5B. This assures that a complete cut is made in the material. In contrast, a single point blade would tend to push the meat 34 apart without necessarily forming a clean cut. Use of the bifurcated end has also been found to be advantageous to prevent blade 20 from laterally deflecting from outer surface 30 along the Y-axis (lateral but perpendicular to the direction of slitting X) because the bifurcated end contacts the curved surface 30 at two points 54.

Slitting blade 20 includes sharp trailing blade edges 55. As blade 20 is retracted from whole fruit 18 the trailing blade edges 55 help to complete the cut and to reduce a tendency to drag the meat 34 of whole fruit 18 along with blade 20.

Figure 8A:
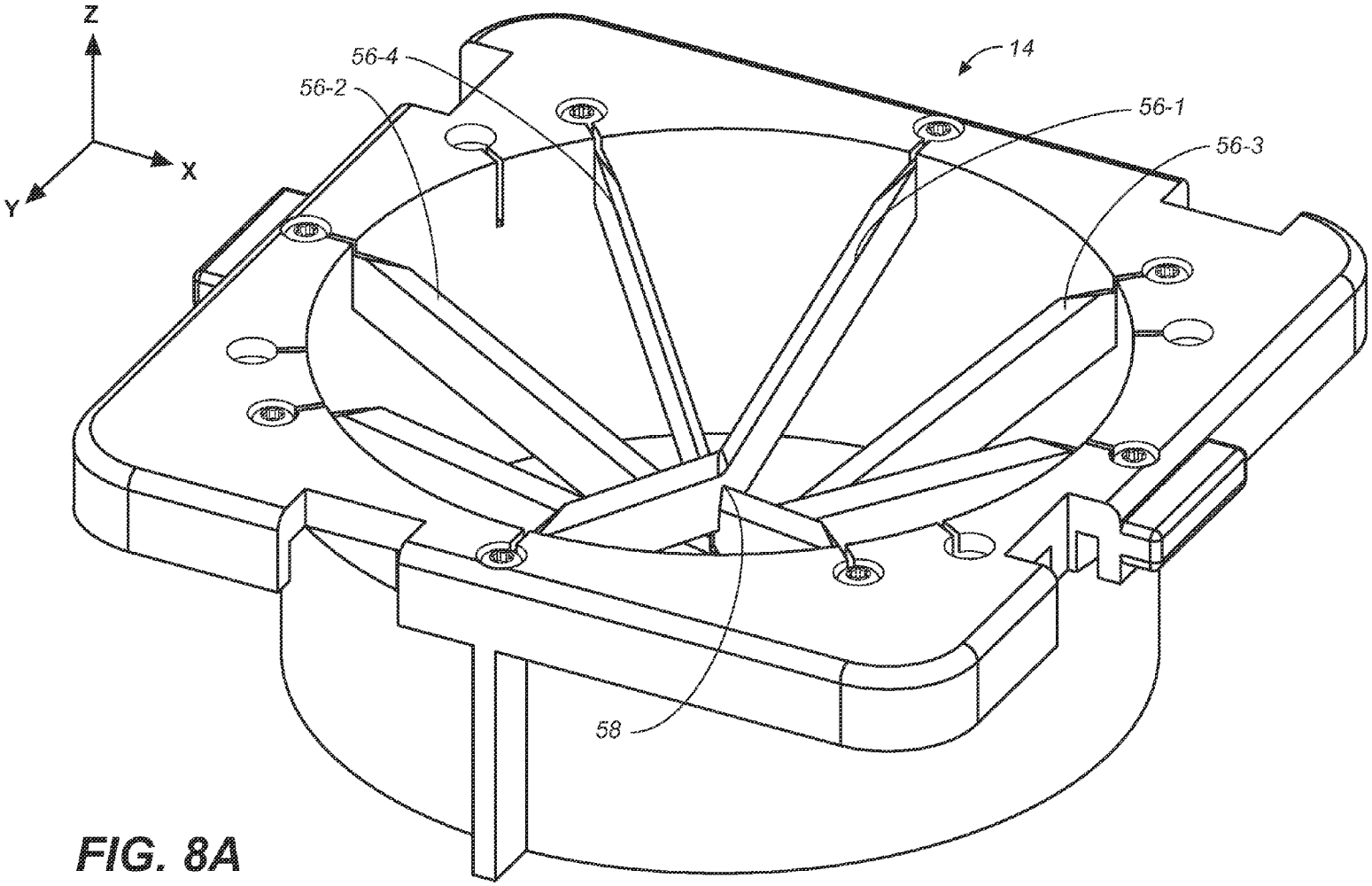
FIG. 8A is an isometric view of a blade set.

FIG. 8A depicts blade set 14 in isometric form. Blade set 14 includes four individual blades 56 that have a vertically offset arrangement along vertical axis Z. As a whole fruit 18 is pressed upon blade set 14, the leading blade 56-1 first contacts the outer surface 30 before the other blades. The next blade to contact surface 30 is blade 56-2, then blade 56-3, and then finally blade 56-4. Thus individual blades 56-1, 56-2, 56-3, and 56-4 each contact and place cuts into surface 30 of whole fruit 18 in sequence. Because the maximum force by each blade 56 against whole fruit 18 is realized when each cut is initiated, the sequential cutting greatly reduces a maximum force applied to surface 30 during the wedging operation. This reduces a likelihood of the wedging process crushing whole fruit 18 and also reduces a force requirement for downward motion of ram 24.

Blades 56 are also assembled together with notches 58. Individual blades 56-1 and 56-2 overlap each other along the Z-axis due to this notched arrangement. Likewise individual blades 56-2 and 56-3 overlap each other along the Z-axis, as do blades 56-3 and 56-4. This reduces an overall height of blade set 14 along the Z-axis while still providing the benefit of the sequential cutting in the wedging operation. Reducing the Z-height of blade set 14 is helpful in reducing the distance that ram 24 needs to travel along the Z-axis during the wedging operation.

Figure 8B:
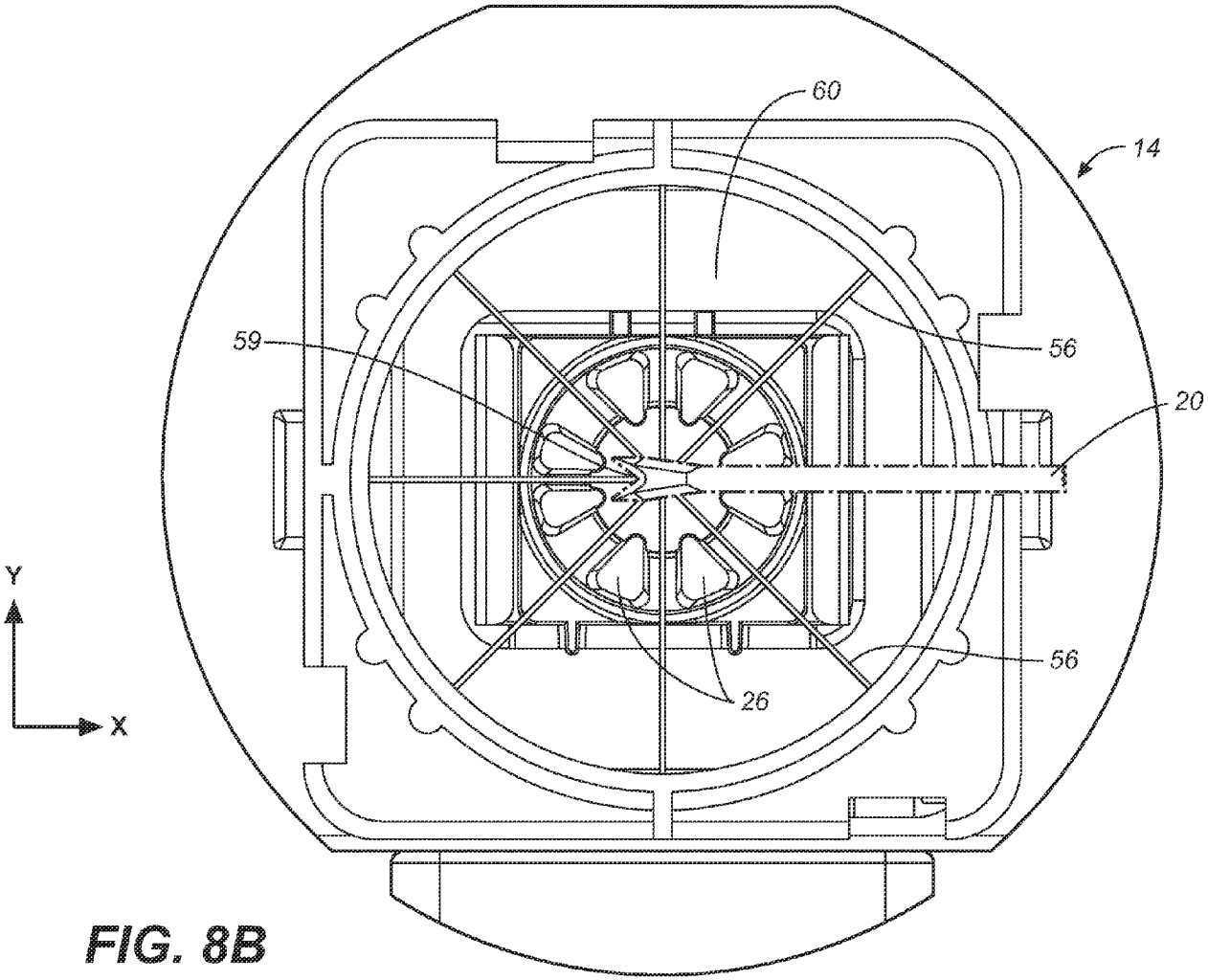
FIG. 8B is a top view depicting the superposition of a blade set with ram fingers extending through openings in between individual blades.

FIG. 8B is a top view of blade set 14 superposed on the ends of ram fingers 26 to illustrate the way in which ram 24 pushes the whole fruit 18 through the blade set 14. Blade set 14 defines openings 60 between blades 56. Thus, when ram 24 and the whole fruit 18 is pushed onto blades 56, the fingers 26 can extend into and through openings 60 to assure that the fruit wedges 32 are pushed out of blade set 14 and into drawer 8 (FIG. 1). As can be seen, fingers 26 are chamfered at their tips proximate to blades 56.

The proper alignment of the fingers 26 to openings 60 is important to prevent a damaging crash between ram fingers 26 and blades 56. Closing access door 6 properly aligns blade set 14 to ram 24 and hence fingers 26 to openings 60.

Also illustrated in FIG. 8B is the superposition of the slitting blade 20 in its fully advanced position over blade set 14. This superposition illustrates some important alignment aspects of the slitting blade 20 with respect to blade set 14. As can be seen, the slitting blade 20 straddles one blade 56 with respect to the Y-axis. Hence the resultant slit 38 (see FIGS. 5B and 5C) straddles two sections 32. Also as can be seen, the notch 59 of blade 20 advances past a center of blade set 14 in order to properly form slits 38 in all of the wedges 32 (FIG. 5B). The center of blade set 14 is the intersection of blades 56 and thereby defines centerline 31 (FIGS. 5A and 5B) which is at the center of the resultant wedge sections 32 which is coincident with apex edge 36 (FIG. 5C).

In an exemplary embodiment, the notch 59 passes at least 0.1 inches past the centerline 31. In another embodiment, the notch 59 passes at least 0.2 inch past the centerline 31. In yet another embodiment, the notch 59 passes the centerline 31 for a distance in the range of 0.2 to 0.3 inch. In yet another embodiment, the notch 59 passes about 0.25 inch past centerline 31.

Figure 9A:
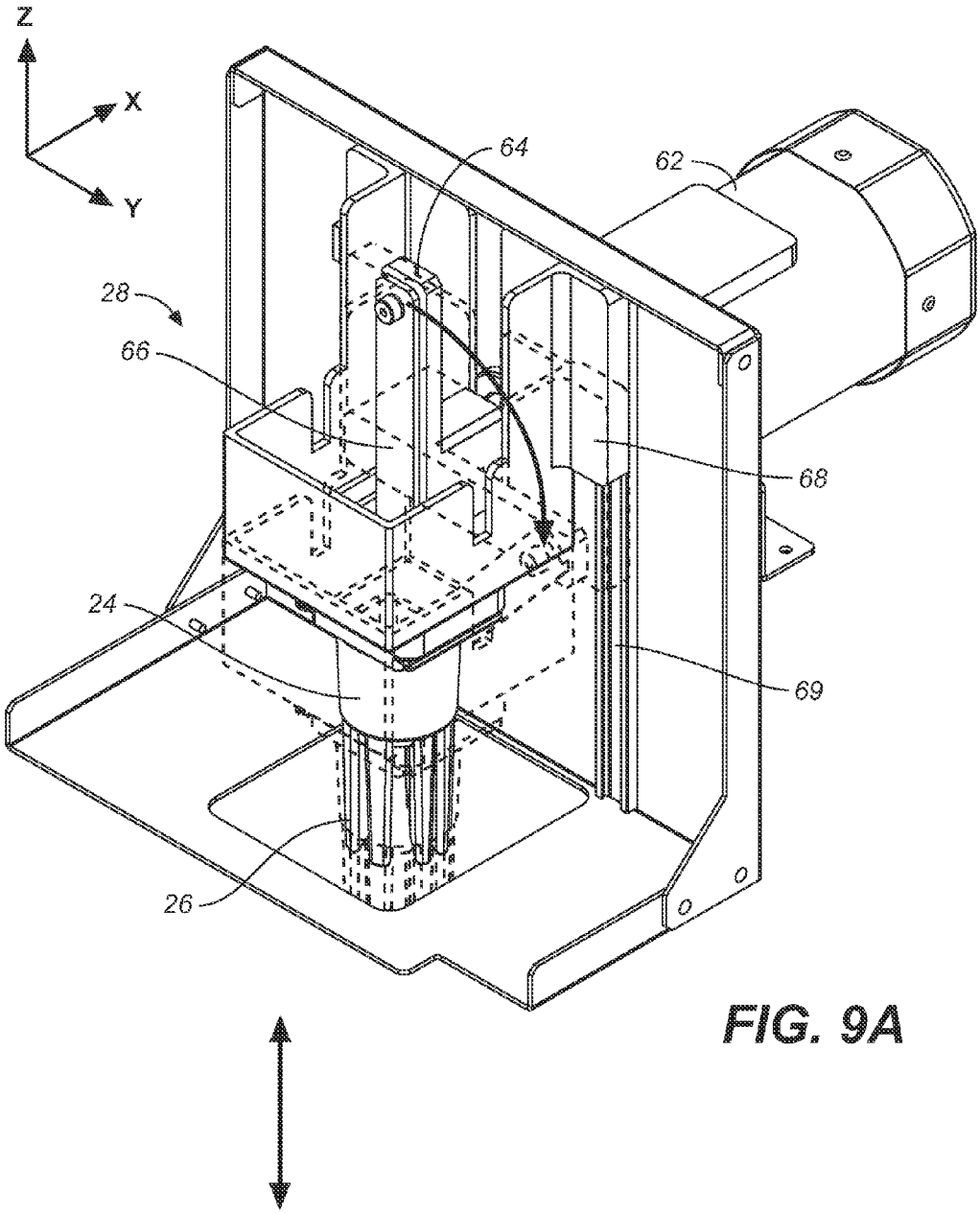
FIG. 9A is an isometric view of a motion actuator coupled to a ram in the raised position.
Figure 9B:
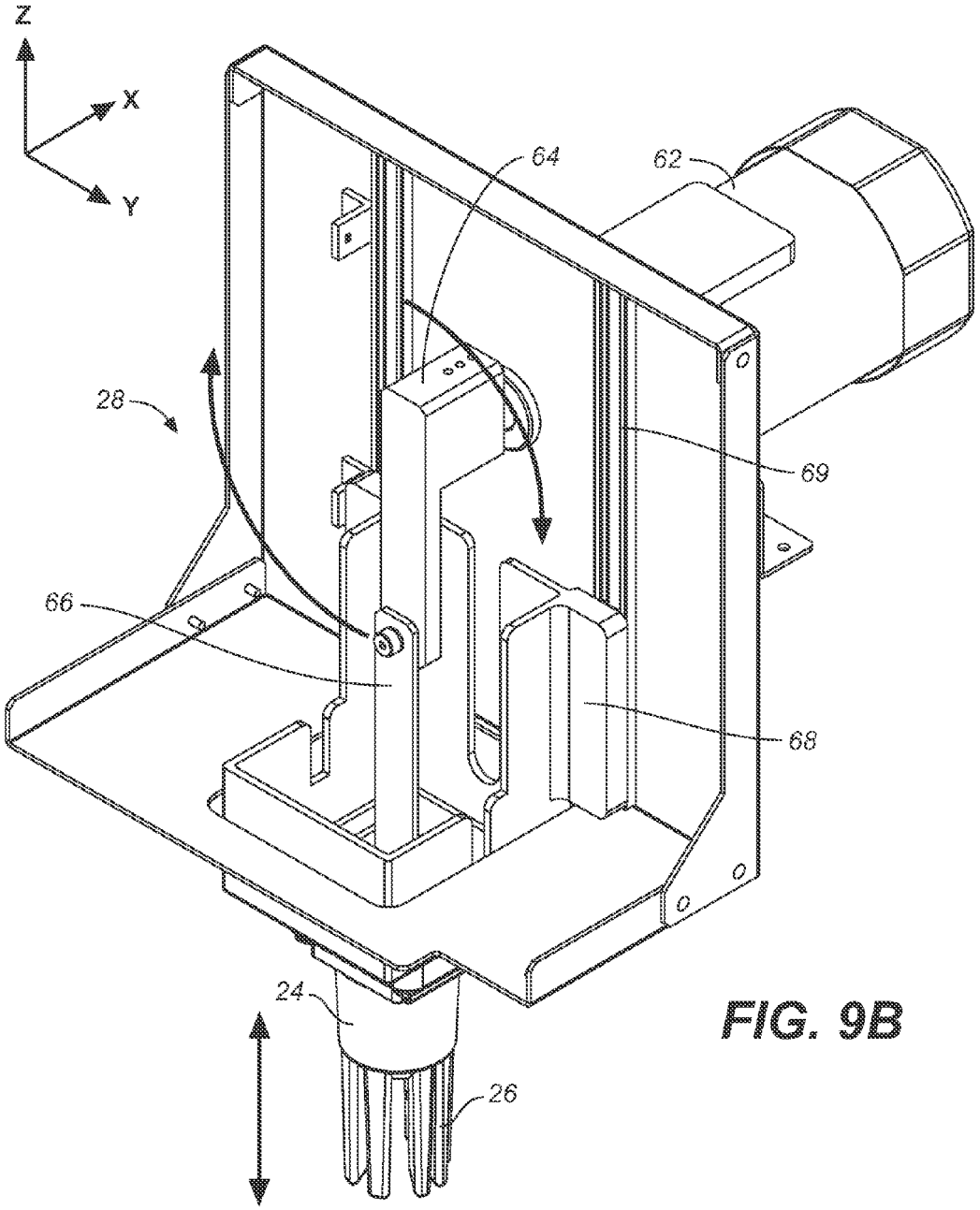
FIG. 9B is an isometric view of a motion actuator coupled to a ram in the lowered position.

FIGS. 9A and 9B depict isometric views of the motion actuator 28 coupled to ram 24. Motion actuators 22 and 28, for slitting blade and ram respectively, have a similar mechanical operating principle. Both have a motor driven linkage that is linearly constrained to provide reciprocal linear motion during a complete machine cycle. Motion actuator 28 includes motor 62, turning arm 64, link 66, and linear slider 68 that linearly translates on slide 69. Ram 24 is mounted to linear slider 68 and thereby constrained to motion along the Z-axis. As motor 62 turns arm 64 along a circle, the linkage formed by turning arm 64 and link 66 cause ram 24 to move up or down depending upon the direction of motor 62 and orientation of arm 64 in the machine cycle. Thus, the up and down motion of ram 24 is provided such that fingers 26 can push down through blade set 14 and then retract to a starting and stopping position above receptacle 12.

FIG. 9A depicts ram 24 in the retracted position with arm 64 oriented upwards (away from receptacle 12). FIG. 9B depicts ram in the lowered position with arm 64 oriented downward (toward receptacle 12).

Figure 10:
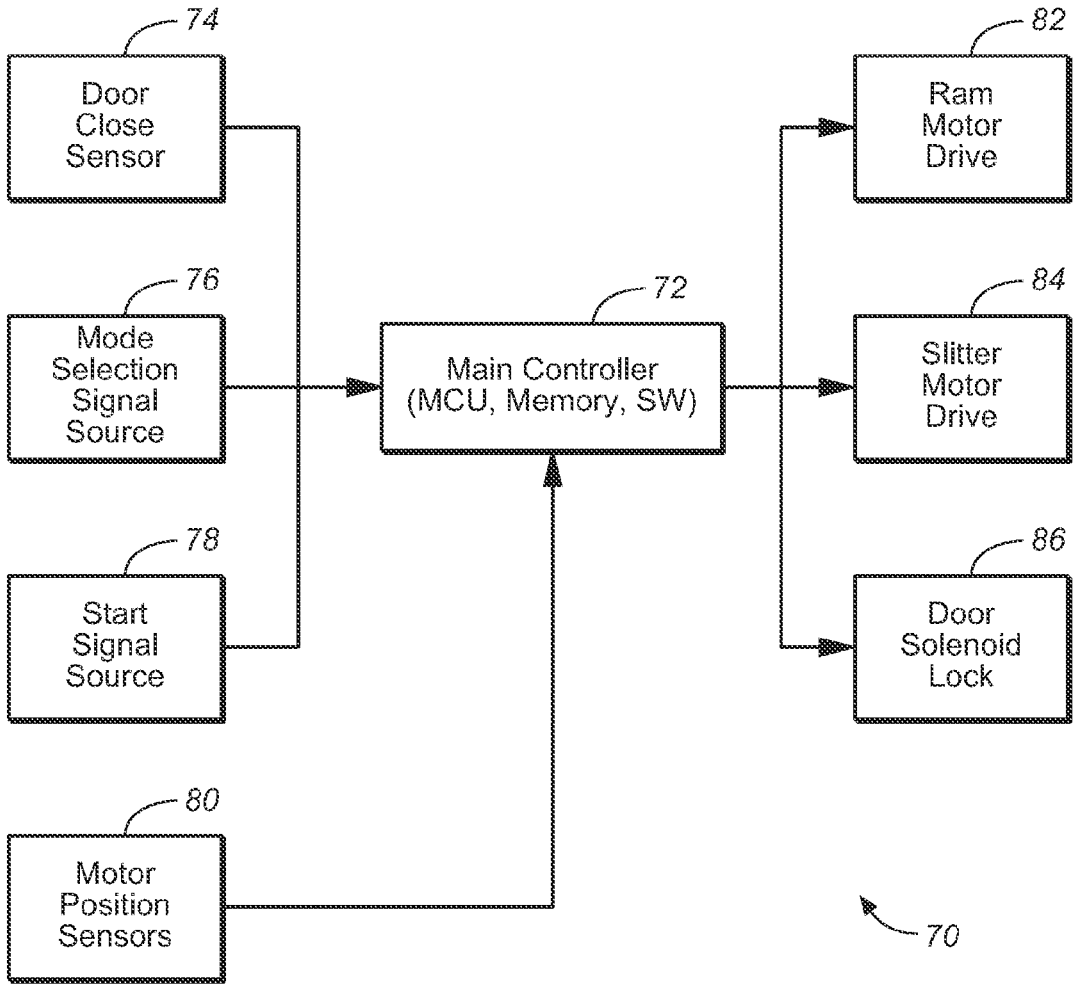
FIG. 10 is a simplified electrical block diagram of a control system for a food processing machine for slitting and wedging whole fruit.

FIG. 10 depicts a simplified electrical block diagram of a control system 70 for machine 2. Control system 70 includes controller 72 linked to door close sensor 74, mode selection signal source 76, start signal source 78, motor position sensors 80, ram motor drive 82, slitter motor drive 84, and door solenoid lock 86. Controller 72 can include a micro controller unit (MCU), memory, and associated software.

Door close sensor 74 is mounted on machine 2 to sense and verify proper closure of door 6. Preferably sensor 74 has a degree of accuracy whereby it senses complete and not just partial closure of door 6 since complete closure is important for aligning receptacle 12 and blade set 14 to ram 24. This provides a safety feature to prevent user injury and protects machine 2 from damage that would occur if ram fingers 26 crash with blades 56 or other portions of blade set 14.

Mode selection signal source 76 is likely to be coupled to user interface 4 (discussed with respect to FIG. 1). In an exemplary embodiment, a user can select between different operating modes including one mode in which both slitting and wedging take place and another mode in which only wedging takes place.

Start signal source 78 provides a signal to controller 72 to start operation of machine 2. In one embodiment the start signal source 78 includes a button that forms part of user interface 4. In another embodiment the start signal source is the door close sensor 74 whereby properly closing the door initiates a mode of operation.

Motor position sensors 80 can be employed to determine the orientation of turning arms 46 and 64 so as to determine the position of slitting blade 20 and ram 24. Thus these sensors enable controller 72 to monitor the operational state of machine 2. Ram motor drive 82 and slitter motor drives 84 enable signals from controller 72 to control motors 62 and 44 respectively.

In a preferred embodiment, a door lock 86 is mounted on machine 2 to lock access door 6 during operation of machine 2. This provides another safety feature to prevent a user from injury. Verifying the proper locking of door lock 86 may also be an added verification that access door is properly aligned with machine 2 during operation. As discussed before, this alignment is important to provide proper alignment between ram 24, receptacle 12, and blade set 14.

Control system 70 provides the various operating modes for machine 2. The operating mode including both slitting and wedging includes the following steps (including those performed by the user). The following steps are exemplary as certain embodiments of the present invention can optionally have fewer or more steps or may change the order of the steps:

(1) The user selects an operating mode via user interface 4. The operating mode selection is communicated to controller 72.

(2) The user opens door 6 and places a whole fruit into receptacle 12. Levers 40 align and hold the whole fruit relative to the blade set 14. Receptacle 12 and blade set 14 are already pre-aligned and affixed to door 6 which simplifies a need for subsequent alignment of the working portions of machine 2. While the door is open the controller 72 blocks operation of machine 2.

(3) The user closes door 6. In response, the door close sensor 74 provides a signal to main controller 72 to enable machine operation.

(4) The controller 72 receives a start signal from a start signal source 78. In one embodiment, signal source 78 is a button actuated by the user. In another embodiment the door close sensor 74 provides the start signal.

(5) The controller 72 activates door lock 86 to lock door 6.

(6) The controller activates the slitter motor drive 84 while monitoring motor position sensors 80. Movement actuator 22 thereby translates blade 20 along the X-axis and places a slit in whole fruit 18 and then retracts the blade 20 to a starting position.

(7) The controller 72 activates ram motor drive 82 while monitoring motor motion sensors 80. Movement actuator 28 translates ram 24 downwardly along the Z-axis to cause fingers to push fruit 18 into blade set 14 and then to retract the ram back to a starting position.

(8) Controller 72 unlocks door lock 86.

The specific embodiments and applications thereof described above are for illustrative purposes only and do not preclude modifications and variations encompassed by the scope of the following claims. For example, in an alternative embodiment, the blade set 14 may have another geometry than that which is depicted in FIGS. 8A and 8B. As one example, the blade set 14 can have a geometry defining square openings 60 which might be suitable for forming French fries. As another example, openings 60 may have other cross sections such as rectangular or with curved blades that form curved cut surfaces.

In another alternative embodiment, the machine 2 may not perform slitting and have only one motion actuator 28 coupled to a ram 24. In this alternative embodiment, machine 2 would perform slicing or wedging but not slitting. Thus there are various embodiments possible within the scope of the invention.

In yet another alternative embodiment, the levers 40 (and extensions 43) may be configured differently and still maintain satisfactory alignment between whole fruit 18 and blade set 14.

We claim:

1. A food processing machine for providing wedge-shaped portions of a whole fruit or vegetable comprising:

a slitting blade coupled to a first motion actuator;

a ram coupled to a second motion actuator;

a blade set;

a controller configured to receive an input signal and to actuate the first and second motion actuators in a sequence including (1) motion of the slitting blade to form a slit into the whole fruit or vegetable along a first axis followed by (2) motion of the ram along a second axis to press the whole fruit or vegetable through the blade set to form fruit or vegetable wedges; and a receptacle configured to hold the whole fruit or vegetable in alignment between the ram and the blade set during the motion sequence, wherein the receptacle is mounted on a door allowing the whole fruit or vegetable to be loaded when the door is open and whereby moving the door to a closed position aligns the receptacle with the ram, and wherein the blade set is affixed to the door in an aligned position with respect to the receptacle whereby closing the door aligns the blade set with the ram.

2. The food processing machine of claim 1 further comprising a sensor configured to generate a sensor signal indicative of door closure whereby the controller will not actuate the motion actuators without the sensor signal indicative of door closure.

3. The food processing machine of claim 1 wherein the controller activates a safety latch that prevents opening the door during the motion sequence.

4. The food processing machine of claim 1 wherein the blade set includes blades that intersect to substantially define a centerline and first motion actuator advances the slitting blade past the centerline to assure formation of slits in all of the wedges.

5. The food processing machine of claim 1 wherein the blade set includes individual blades defining vertical section lines and wherein the slitting blade is aligned to straddle one of the vertical section lines whereby slitting spans two wedges.

6. The food processing machine of claim 1 wherein at least one of the first and second motion actuators include a motor-driven linkage coupled to a linear slide mechanism.

7. An automated food processing machine for providing wedge-shaped portions of a whole fruit or vegetable comprising:

a fixed blade set defining openings between blades of the fixed blade set;

a receptacle configured to receive and hold the whole fruit or vegetable in alignment with the fixed blade set;

a slitting blade coupled to a first actuator and constrained to move along a first axis;

a ram coupled to a second actuator and constrained to move along a second axis that is substantially perpendicular to the first axis, the ram including fingers extending along the second axis toward the fixed blade set; and a controller configured to receive an input and in response to activate one or more of the first and second actuators including moving the fingers to press the fruit or vegetable through the receptacle and to pass through the openings between the blades of the fixed blade set to form sliced portions of the whole fruit or vegetable wherein the receptacle and blade set are affixed to a door in an aligned state whereby closing the door aligns the openings between the blades with the fingers of the ram.

8. The automated food processing machine of claim 7 wherein the receptacle includes opposing spring loaded levers that align the whole fruit to a central axis.

9. The automated food processing machine of claim 7 wherein the slitting blade has a bifurcated blade defining two blade tips and notch to improve the quality of a slitting operation.

10. The automated food processing machine of claim 9 wherein the blade set includes individual blades that intersect to substantially define a vertical centerline, the first actuator is configured to translate the slitting blade such that a portion of the slitting blade between the tips passes the centerline.

11. The automated food processing machine of claim 9 wherein the slitting blade includes trailing blade edges that cut during extraction of the blade to further improve quality of the slitting operation.

12. The automated food processing machine of claim 7 wherein the blade set includes individual blades that are offset along the second axis such that the blades sequentially pierce the whole fruit or vegetable in order to reduce a force exerted upon the fruit or vegetable along the second axis, the individual blades have a notched structure to minimize a height of the blade set along the second axis.

13. The automated food processing machine of claim 7 wherein the controller is configured to receive a mode selection input and to execute an operational mode including one of: (1) a mode whereby the second actuator translates the ram to form wedges without slits and (2) a mode whereby the first actuator translates the slitting blade to place a slit in the fruit or vegetable followed by the second actuator translating the ram to form slit wedges.

14. A food processing machine for providing wedge-shaped portions of a whole fruit or vegetable comprising:

a slitting blade coupled to a first motion actuator;

a ram coupled to a second motion actuator;

a blade set having a center where blades of the blade set intersect; and a controller configured to receive an input signal and to actuate the first and second motion actuators in a sequence including (1) motion of the slitting blade past the center of the blade set to form a slit into the whole fruit or vegetable along a first axis followed by (2) motion of the ram along a second axis to press the whole fruit or vegetable through the blade set to form fruit or vegetable wedges each wedge having an apex edge and a slit formed into the apex edge by the slitting blade moving past the center of the blade set.

15. The food processing machine of claim 14 further comprising a receptacle configured to hold the whole fruit or vegetable in alignment between the ram and the blade set during the motion sequence.

16. The food processing machine of claim 15 wherein the receptacle is mounted on a door allowing the whole fruit or vegetable to be loaded when the door is open and whereby moving the door to a closed position aligns the receptacle with the ram.

17. The food processing machine of claim 16 wherein the blade set is affixed to the door in an aligned position with respect to the receptacle whereby closing the door aligns the blade set with the ram.

18. The food processing machine of claim 16 further comprising a sensor configured to generate a sensor signal indicative of door closure whereby the controller will not actuate the motion actuators without the sensor signal indicative of door closure.

19. The food processing machine of claim 16 wherein the controller activates a safety latch that prevents opening the door during the motion sequence.

20. An automated food processing machine for providing wedge-shaped portions of a whole fruit or vegetable comprising:

a fixed blade set defining openings between blades of the fixed blade set, the blades intersecting at a center of the blade set for forming an apex edge of each wedge-shaped portion;

a receptacle configured to receive and hold the whole fruit or vegetable in alignment with the fixed blade set;

a slitting blade coupled to a first actuator and constrained to move along a first axis and past the center of the fixed blade set to define a slit in each of the apex edges;

a ram coupled to a second actuator and constrained to move along a second axis that is substantially perpendicular to the first axis, the ram including fingers extending along the second axis toward the fixed blade set; and a controller configured to receive an input and in response to activate one or more of the first and second actuators including moving the fingers to press the fruit or vegetable through the receptacle and to pass through the openings between the blades of the fixed blade set to form sliced portions of the whole fruit or vegetable.

21. The automated food processing machine of claim 20 wherein the receptacle and blade set are affixed to a door in an aligned state whereby closing the door aligns the openings between the blades with the fingers of the ram.

22. The automated food processing machine of claim 20 wherein the receptacle includes opposing spring loaded levers that align the whole fruit to a central axis.

* * * * *